US007637122B2

(12) United States Patent
Turner et al.

(10) Patent No.: US 7,637,122 B2
(45) **Date of Patent: *Dec. 29, 2009**

(54) APPARATUS FOR THE LIQUEFACTION OF A GAS AND METHODS RELATING TO SAME

(75) Inventors: Terry D. Turner, Idaho Falls, ID (US); Bruce M. Wilding, Idaho Falls, ID (US); Michael G. McKellar, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 328 days.

This patent is subject to a terminal disclaimer.

(21) Appl. No.: 11/536,477

(22) Filed: Sep. 28, 2006

(65) Prior Publication Data

US 2007/0017250 A1 Jan. 25, 2007

Related U.S. Application Data

(60) Continuation-in-part of application No. 11/124,589, filed on May 5, 2005, now Pat. No. 7,219,512, which is a continuation of application No. 10/414,991, filed on Apr. 14, 2003, now Pat. No. 6,962,061, which is a division of application No. 10/086,066, filed on Feb. 27, 2002, now Pat. No. 6,581,409, said application No. 11/536,477 and a continuation-in-part of application No. 11/381,904, filed on May 5, 2006, , said application No. 11/536,477 and a continuation-in-part of application No. 11/383,411, filed on May 15, 2006.

(60) Provisional application No. 60/288,985, filed on May 4, 2001.

(51) Int. Cl.
*F25J 1/00* (2006.01)
*B01D 9/04* (2006.01)

(52) U.S. Cl. ..... 62/611; 62/613; 62/532; 62/537

(58) Field of Classification Search ..... 62/611, 62/613, 532, 537
See application file for complete search history.

(56) References Cited

U.S. PATENT DOCUMENTS 1,222,801 A 4/1917 Rosenbaum (Continued)

FOREIGN PATENT DOCUMENTS

DE 1 443 597 1/1970

(Continued)

OTHER PUBLICATIONS

"A National Vision of America's Transition to a Hydrogen Economy—To 2030 and Beyond," Based on the results of the National Hydrogen Vision Meeting Washington, DC Nov. 15-16, 2001, United States Department of Energy.

(Continued)

*Primary Examiner*—William C Doerrler
(74) *Attorney, Agent, or Firm*—TraskBritt

(57) ABSTRACT

Apparatuses and methods are provided for producing liquefied gas, such as liquefied natural gas. In one embodiment, a liquefaction plant may be coupled to a source of unpurified natural gas, such as a natural gas pipeline at a pressure let-down station. A portion of the gas is drawn off and split into a process stream and a cooling stream. The cooling stream may sequentially pass through a compressor and an expander. The process stream may also pass through a compressor. The compressed process stream is cooled, such as by the expanded cooling stream. The cooled, compressed process stream is expanded to liquefy the natural gas. A gas-liquid separator separates the vapor from the liquid natural gas. A portion of the liquid gas may be used for additional cooling. Gas produced within the system may be recompressed for reintroduction into a receiving line.

36 Claims, 5 Drawing Sheets

U.S. PATENT DOCUMENTS 2,209,534 A 7/1940 Moore
2,494,120 A 1/1950 Ferro, Jr.
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johnason
3,193,468 A 7/1965 Sprague
3,213,631 A 10/1965 Kniel
3,236,057 A 2/1966 Hadi Hashemi-Tafreshi
3,254,496 A 6/1966 Roche et al.
3,292,380 A 12/1966 Bucklin
3,312,073 A 4/1967 Jackson et al.
3,315,475 A 4/1967 Harmens
3,323,315 A 6/1967 Carr
3,326,453 A 6/1967 Kun
3,349,020 A 10/1967 Crownover et al.
3,362,173 A 1/1968 Kniel
3,376,709 A 4/1968 Dickey et al.
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,677,019 A * 7/1972 Olszewski ..... 62/613
3,690,114 A 9/1972 Swearingen et al.
3,724,225 A 4/1973 Mancini et al.
3,724,226 A 4/1973 Pachalay
3,735,600 A 5/1973 Dowdell et al.
3,846,993 A 11/1974 Bates
3,897,226 A 7/1975 Doherty
4,001,116 A 1/1977 Selcukoglu
4,007,601 A 2/1977 Webbon
4,022,597 A 5/1977 Bacon
4,120,911 A 10/1978 Davidson
4,128,410 A 12/1978 Bacon
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradiwski
4,359,871 A 11/1982 Strass
4,370,150 A 1/1983 Fenstermaker
4,453,956 A 6/1984 Fabbri et al.
4,479,533 A 10/1984 Persson et al.
4,479,536 A 10/1984 Lameris
4,522,636 A 6/1985 Markbreiter et al.
4,561,496 A 12/1985 Kehrer
4,609,390 A 9/1986 Wilson
4,611,655 A 9/1986 Molignoni
4,654,522 A 3/1987 Gornick et al.
4,798,242 A 1/1989 Kito et al.
4,846,862 A 7/1989 Cook
4,869,313 A 9/1989 Fredley
4,970,867 A 11/1990 Harron et al.
4,993,485 A 2/1991 Gorman
5,003,782 A 4/1991 Kucerija
5,062,270 A 11/1991 Haut et al.
5,174,796 A 12/1992 Davis et al.
5,218,832 A 6/1993 Woolley
5,291,736 A 3/1994 Paradowski
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 * 4/2001 Hass et al. ..... 62/613
6,250,244 B1 6/2001 Dubar et al.
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,400,896 B1 6/2002 Longardner
6,412,302 B1 7/2002 Foglietta
6,427,464 B1 8/2002 Beaverson et al.
6,484,533 B1 11/2002 Allam et al.
6,581,510 B2 6/2003 Koch et al.
6,694,774 B1 2/2004 Rashad et al.
6,767,388 B2 7/2004 Lecomte et al.
2003/0196452 A1 10/2003 Wilding et al.
2004/0083888 A1 5/2004 Qualls
2004/0105812 A1 6/2004 Tonkovich et al.
2004/0148962 A1 8/2004 Rashad et al.
2005/0220704 A1 10/2005 Morrow et al.

FOREIGN PATENT DOCUMENTS

EP 0 676 599 A 10/1995
EP 1 205 721 A1 5/2002
JP 11200817 A 7/1999
JP 2002071861 A 3/2002
WO WO 88/00936 2/1988
WO WO 98/59206 12/1998

WO 03/062725 A 7/2003

OTHER PUBLICATIONS

"Generation of Hydrogen and Transportation and Transmission of Energy Generated on the U.S. Outer Continental Shelf to Onshore," (Minerals Management Service), May 2006.

"Hydrogen as an Energy Carrier and its Production by Nuclear Power," IAEA-TECDOC-1085, International Atomic Energy Agency, May 1999.

"Hydrogen Infrastructure Delivery, Reliability R&D Needs," Science Applications International Corporation, Prepared for U.S. Department of Energy, NETL Natural Gas & Infrastructure Reliability Program <www.netl.doe.gov/technologies/oil-gas/publications/td/Final%20White%20Paper%20072604.pdf>.

Mott Corporation, "Porous metal solutions," Jun. 2007, 16 pages.

"Porous Metal Design Guidebook," Metal Powder Industries Federation, Princeton, NJ, <<http://www.mpif.org/designcenter/porous.pdf>>, Jun. 2007, 25 pages.

"The Hydrogen Economy: Opportunities, Costs, Barriers, and R&D Needs," National Academy of Engineering and Board on Energy and Environmental Systems, 2004, The National Academies Press, <http://books.nap.edu/books/0309091632/html/index.html>.

"The Hydrogen Initiative, Panel on Public Affairs," American Physical Society, Mar. 2004, <http://www.aps.org/public_affairs/popa/reports/index.cfm>.

Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.

Curtin University of Technology, LNG Microcell Progress Update, May 2002, Curtin/Corelab.

International Search Report dated Sep. 17, 2002 (4 pages).

PCT International Preliminary Report on Patentability and Written Opinion for PCT/US2007/084677 dated May 28, 2009, 7 pages.

PCT International Preliminary Report on Patentability and Written Opinion for PCT/US2006/041039 dated Apr. 9, 2009, 7 pages.

PCT International Search Report and Written Opinion for PCT/US08/68938 dated Oct. 10, 2008, 8 pages.

PCT International Preliminary Report on Patentability and Written Opinion for PCT/US2008/051012 dated Aug. 27, 2009, 7 pages.

* cited by examiner

APPARATUS FOR THE LIQUEFACTION OF A GAS AND METHODS RELATING TO SAME

CROSS-REFERENCE TO RELATED APPLICATIONS

This application is a continuation-in-part of U.S. patent application Ser. No. 11/124,589, filed May 5, 2005, now U.S. Pat. No. 7,219,512, issued May 22, 2007, which is a continuation of U.S. patent application Ser. No. 10/414,991, filed Apr. 14, 2003, now U.S. Pat. No. 6,962,061, issued Nov. 8, 2005, which is a divisional of U.S. patent application Ser. No. 10/086,066, filed Feb. 27, 2002, now U.S. Pat. No. 6,581,409, issued Jun. 24, 2003 and which claims the benefit of U.S. Provisional Patent Application Ser. No. 60/288,985, filed May 4, 2001. This Application is also a continuation-in-part of U.S. patent application Ser. No. 11/381,904, filed May 5, 2006, entitled APPARATUS FOR THE LIQUEFACTION OF NATURAL GAS AND METHODS RELATING TO SAME, which is also a continuation-in-part of the above-referenced U.S. patent application Ser. No. 11/124,589, filed May 5, 2005. Further, this application is a continuation-in-part of U.S. patent application Ser. No. 11/383,411, filed May 15, 2006, entitled APPARATUS FOR THE LIQUEFACTION OF NATURAL GAS ANT) METHODS RELATING TO SAME, which is also a continuation-in-part of the above-referenced U.S. patent application Ser. No. 11/124,589, filed May 5, 2005, and U.S. patent application Ser. No. 11/381,904, filed May 5, 2006. This application is also related to U.S. patent application Ser. No. 11/674,984, filed Feb. 14, 2007, U.S. patent application Ser. No. 11/560,682, filed Nov. 16, 2006, U.S. patent application Ser. No. 11/855,071, filed Sep. 13, 2007, and U.S. patent application Ser. No. 09/643,420, filed Aug. 23, 2001, now U.S. Pat. No. 6,425,263, issued Jul. 30, 2002, which is a continuation of U.S. patent application Ser. No. 09/212,490, filed Dec. 16, 1998, now U.S. Pat. No. 6,105,390, issued Aug. 22, 2000, which claims benefit of U.S. Provisional Application Ser. No. 60/069,988 filed Dec. 16, 1997. The disclosures of the above-referenced priority patents and patent applications are each incorporated by reference herein in their entireties.

GOVERNMENT RIGHTS

This invention was made with government support under Contract No. DE-AC07-05ID14517awarded by the U.S. Department of Energy. The United States Government has certain rights in this invention.

BACKGROUND OF THE INVENTION

1. Field of the Invention

The present invention relates generally to the compression and liquefaction of gases and, more particularly, to the liquefaction of a gas, such as natural gas, on a relatively small scale by, for example, utilizing a combined refrigerant and expansion process.

2. State of the Art

Natural gas is a known alternative to combustion fuels such as gasoline and diesel. Much effort has gone into the development of natural gas as an alternative combustion fuel in order to combat various drawbacks of gasoline and diesel including production costs and the subsequent emissions created by the use thereof. As is known in the art, natural gas is a cleaner burning fuel than other combustion fuels. Additionally, natural gas is considered to be safer than gasoline or diesel as leaking natural gas will rise in the air and dissipate, rather than settling or accumulating.

To be used as an alternative combustion fuel, natural gas (also termed "feed gas" herein) is conventionally converted into compressed natural gas (CNG) or liquified (or liquid) natural gas (LNG) for purposes of storing and transporting the fuel prior to its use. Conventionally, two of the known, basic processes used for the liquefaction of natural gases are referred to as the "cascade cycle" and the "expansion cycle."

Briefly, the cascade cycle consists of subjecting the feed gas to a series of heat exchanges, each exchange being at successively lower temperatures until the desired liquefaction is accomplished. The levels of refrigeration are obtained with different refrigerants or with the same refrigerant at different evaporating pressures. The cascade cycle is considered to be relatively efficient at producing LNG as operating costs are relatively low. However, the efficiency in operation is often seen to be offset by the relatively high investment costs associated with the expensive heat exchange equipment and the compression equipment associated with the refrigerant system. Additionally, a liquefaction plant incorporating such a system may be impractical where physical space is limited, as the physical components used in cascading systems are relatively large.

In an expansion cycle, gas is conventionally compressed to a selected pressure, cooled, and then allowed to expand through an expansion turbine, thereby producing work as well as reducing the temperature of the feed gas. The low temperature feed gas is then heat exchanged to effect liquefaction of the feed gas. Conventionally, such a cycle has been seen as being impracticable in the liquefaction of natural gas since there is no provision for handling some of the components present in natural gas which freeze at the temperatures encountered in the heat exchangers, for example, water and carbon dioxide. It is noted that the need for expensive pre-clean-up or prepurification is also an issue associated with the cascade cycle.

Additionally, to make the operation of conventional systems cost effective, such systems are conventionally built on a large scale for the processing of large volumes of natural gas. As a result, fewer facilities are built overall, making it more difficult to provide the raw gas to the liquefaction plant or facility as well as making distribution of the liquefied product an issue. Another major issue with large-scale facilities is the capital and operating expenses associated therewith. For example, a conventional large-scale liquefaction plant, i.e., producing on the order of 70,000 gallons of LNG per day, may cost $2 million to $15 million, or more, in capital expenses. Also, such a plant may require thousands of horsepower to drive the compressors associated with the refrigerant cycles, making the daily operation of the plants expensive.

An additional problem with large facilities is the cost associated with storing large amounts of fuel in anticipation of future use and/or transportation. Not only is there a cost associated with building large storage facilities, but there is also an efficiency issue related therewith. For example, stored LNG will tend to warm and vaporize over time, creating a loss of the LNG fuel product. Further, safety may become an issue when larger volumes of LNG fuel product are stored.

In confronting the foregoing issues, various systems have been devised which attempt to produce LNG or CNG from feed gas on a smaller scale, in an effort to eliminate long-term storage issues and to reduce the capital and operating expenses associated with the liquefaction and/or compression of natural gas. However, such systems and techniques have all suffered from one or more drawbacks.

U.S. Pat. No. 5,505,232 to Barclay, issued Apr. 9, 1996 is directed to a system for producing LNG and/or CNG. The disclosed system is stated to operate on a small scale, producing approximately 1,000 gallons a day of liquefied or compressed fuel product. However, the liquefaction portion of the system itself requires the flow of a "clean" or "purified" gas, meaning that various constituents in the gas such as carbon dioxide, water, or heavy hydrocarbons must be removed before the actual liquefaction process can begin.

Similarly, U.S. Pat. Nos. 6,085,546 and 6,085,547 both issued Jul. 11, 2000 to Johnston, describe methods and systems of producing LNG. The Johnston patents are both directed to small-scale production of LNG, but again, both require "prepurification" of the gas in order to implement the actual liquefaction cycle. The need to provide "clean" or "prepurified" gas to the liquefaction cycle is based on the fact that certain gas components might freeze and plug the system during the liquefaction process because of their relatively higher freezing points as compared to methane, which makes up the larger portion of natural gas.

Since many sources of natural gas, such as residential or industrial service gas, are considered to be relatively "dirty," the requirement of providing "clean" or "prepurified" gas is actually a requirement of implementing expensive and often complex filtration and purification systems prior to the liquefaction process. This requirement simply adds expense and complexity to the construction and operation of such liquefaction plants or facilities.

In view of the shortcomings in the art, it would be advantageous to provide a process, and a system or a plant for carrying out such a process, of efficiently producing liquefied natural gas on a small scale. Additionally, it would be advantageous to provide a system for producing liquefied natural gas from a source of relatively "dirty" or "unpurified" natural gas without the need for "prepurification." Such a system or process may include various clean-up cycles which are integrated with the liquefaction cycle for purposes of efficiency.

It would be additionally advantageous to provide a plant or a system for the liquefaction of natural gas which is relatively inexpensive to build and operate, and which desirably requires little or no operator oversight.

It would be additionally advantageous to provide such a plant or a system which is easily transportable and which may be located and operated at existing sources of natural gas which are within or near populated communities, thus providing easy access for consumers of LNG fuel.

It is a continual desire to improve the efficiency and effectiveness of liquefaction processes and systems.

BRIEF SUMMARY OF THE INVENTION

In one embodiment of the invention, a method of liquefying a gas is provided. The method includes providing a source of the gas and flowing a portion of the gas from the source. The portion of gas is divided into at least a process stream and a cooling stream. The process stream is flowed sequentially through a first compressor and a first side of at least one heat exchanger. The cooling stream is flowed sequentially through a second compressor and a second side of the at least one heat exchanger. The at least a portion of the process stream is expanded subsequent flowing the process stream through the first side of at least one heat exchanger to produce a liquid.

The method may further include cooling the process stream to form a slurry within the separator, the slurry comprising at least liquid natural gas and solid carbon dioxide. Cooling the portion of the mass of natural gas may be accomplished by expanding the gas, such as through one or more Joule-Thomson valves. The slurry may be flowed into one or more hydrocyclones by way of one or more pressurized transfer tanks. The transfer tanks may be used alternately or sequentially so as to provide a continuous transfer of slurry to the hydrocyclones. The hydrocyclones substantially separate the solid carbon dioxide and the liquid natural gas. A thickened slush may exit an underflow of the hydrocyclone wherein the thickened slush may include the solid carbon dioxide and a portion of the liquid natural gas. The remaining portion of liquid natural gas is flowed through an overflow of the hydrocyclone.

In another embodiment of the present invention, a liquefaction apparatus or system, which may also be termed a "plant," is provided. The liquefaction plant includes a first flow path defined and configured for sequential delivery of a first stream of gas through a first compressor and a first side of at least one heat exchanger and a second flow path defined and configured for sequential delivery of a second stream of gas through a second compressor and a second side of the at least one heat exchanger. A product flow path is defined and configured for delivery of the first stream of gas from the first flow path through at least one expansion device and into a gas liquid separator.

The liquefaction plant may include additional components including a plurality of transfer tanks configured to sequentially or alternately fill with slurry and transfer the slurry to one or more hydrocyclones. The hydrocyclones may be used to separate solids from the liquids. Additionally, filters may be used to further remove solids from the liquids. A sublimation tank may be coupled to the hydrocyclones and configured to receive the solids and sublime them back to a gaseous state.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
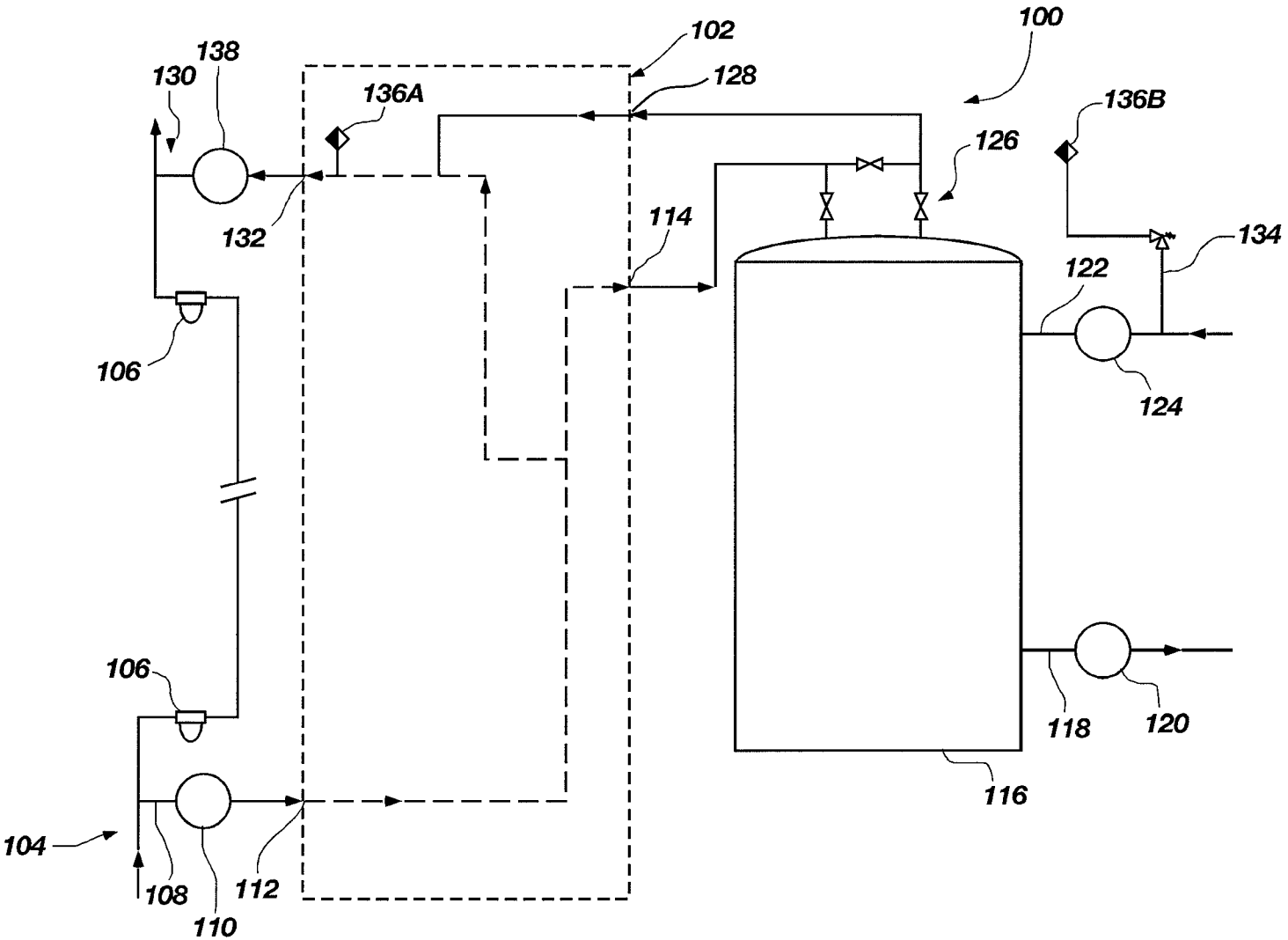
FIG. 1 is a schematic overview of a liquefaction plant according to one embodiment of the present invention.

Referring to FIG. 1, a schematic overview of a portion of a liquefied natural gas (LNG) station 100 is shown according to one embodiment of the present invention. It is noted that, while the present invention is set forth in terms of liquefaction of natural gas, the present invention may be utilized for the liquefaction of other gases as will be appreciated and understood by those of ordinary skill in the art.

The liquefaction station 100 includes a "small-scale" natural gas liquefaction plant 102 which is coupled to a source of natural gas such as a supply line or a pipeline 104, although other sources, such as a well head, are contemplated as being equally suitable. The term "small-scale" is used to differentiate such a plant from a larger-scale plant having the capacity of producing, for example 70,000 gallons of LNG or more per day. In comparison, the presently disclosed liquefaction plant may have the capacity of producing, for example, approximately 10,000 gallons of LNG a day but may be scaled to produce a different output as needed and is not limited to small-scale operations or plants. Additionally, the liquefaction plant 102 of the present invention is considerably smaller in physical size than conventional large-scale plants and may be readily transported from one site to another.

One or more pressure regulators 106 may be positioned along the pipeline 104 for controlling the pressure of the gas flowing therethrough. Such a configuration is representative of a pressure letdown station wherein the pressure of the natural gas is reduced from the high transmission pressures at an upstream location to a pressure suitable for distribution to one or more customers at a downstream location. Upstream of the pressure regulators 106, for example, the pressure in the pipeline 104 may be approximately 600 to 800 pounds per square inch gauge (psig) while the pressure downstream of the pressure regulators 106 may be reduced to approximately 470 psig, or less. Of course, such pressures are merely examples and may vary depending on the particular pipeline 104 and the needs of the downstream customers. It is noted that the available pressure of the upstream gas in the pipeline 104 (i.e., at plant inlet 112) is not critical as the pressure thereof may be raised, for example by use of an auxiliary booster pump, compressor, or heat exchanger prior to the gas entering the liquefaction process described herein. However, it is believed that, generally, higher supply pressures will provide increased yields of liquefied natural gas.

It is further noted that the pressure regulators 106 may be positioned near the liquefaction plant 102 or at some distance therefrom. As will be appreciated by those of ordinary skill in the art, in some embodiments such regulators 106 may be associated with, for example, low pressure lines crossing with high pressure lines or with different flow circuits.

Prior to any reduction in pressure along the pipeline 104, a stream of feed gas 108 is split off from the pipeline 104 and fed through a flow meter 110 that measures and records the amount of gas flowing therethrough. The stream of feed gas 108 then enters the small-scale liquefaction plant 102 through a plant inlet 112 for processing, as will be set forth in further detail hereinbelow. A portion of the feed gas 108 entering the liquefaction plant 102 becomes LNG and exits the liquefaction plant 102 at a plant outlet 114 for storage in a suitable tank or vessel 116. In one embodiment, the vessel 116 is configured to hold at least 10,000 gallons of LNG at a pressure of approximately 50 pounds per square inch absolute (psia) and at temperatures, for example, as low as approximately −230° F. However, other vessel sizes and configurations may be utilized, for example, depending on specific output and storage requirements associated with the liquefaction plant 102.

A vessel outlet 118 is coupled to a flow meter 120 in association with dispensing the LNG from the vessel 116, such as to a vehicle that is powered by LNG or into a transport vehicle as may be required. A vessel inlet 122, coupled with a valve/meter set 124 which could include flow and or process measurement devices, enables the venting and/or purging of a vehicle's tank during dispensing of LNG from the vessel 116. Piping 126 associated with the vessel 116 and connected with a second plant inlet 128 provides flexibility in controlling the flow of LNG from the liquefaction plant 102 and also enables the flow to be diverted away from the vessel 116, recirculated through the liquefaction plant 102, or for drawing vapor from the vessel 116, if such actions should be desirable depending on the operation mode and conditions of the liquefaction plant 102.

The liquefaction plant 102 is also coupled to a downstream section 130 of the pipeline 104 at a second plant outlet 132 for discharging the portion of natural gas not liquefied during the process conducted within liquefaction plant 102, along with other constituents which may be removed during production of the LNG. Optionally, adjacent the vessel inlet 122, vent piping 134 may be coupled with piping of liquefaction plant 102 as indicated by interface connections 136A and 136B. Such vent piping 134 will similarly carry gas into the downstream section 130 of the pipeline 104. As noted above, while the second plant outlet 132 is shown as being coupled with the pipeline 104, the second plant outlet 132 could actually be configured for discharging into a different pipeline, a different circuit of the same pipeline, or into some other structure if desired.

Assuming that the second plant outlet 132 is coupled with the pipeline 104, as the various gas components leave the liquefaction plant 102 and enter into the downstream section 130 of the pipeline 104, a valve/meter set 138, which could include flow and/or process measuring devices, may be used to measure the flow of gas therethrough. The valve/meter sets 124 and 138, as well as the flow meters 110 and 120, may be positioned outside of the liquefaction plant 102 and/or inside the liquefaction plant 102 as may be desired. Thus, flow meters 110 and 120, when the outputs thereof are compared, help to determine the net amount of feed gas 140 removed from the pipeline 104 as the upstream flow meter 110 measures the gross amount of gas removed and the downstream flow meter 138 measures the amount of gas placed back into the pipeline 104, the difference being the net amount of feed gas 140 removed from pipeline 104. Similarly, optional flow meter 120 and valve meter set 124 indicate the net discharge of LNG from the vessel 116.

Figure 2:
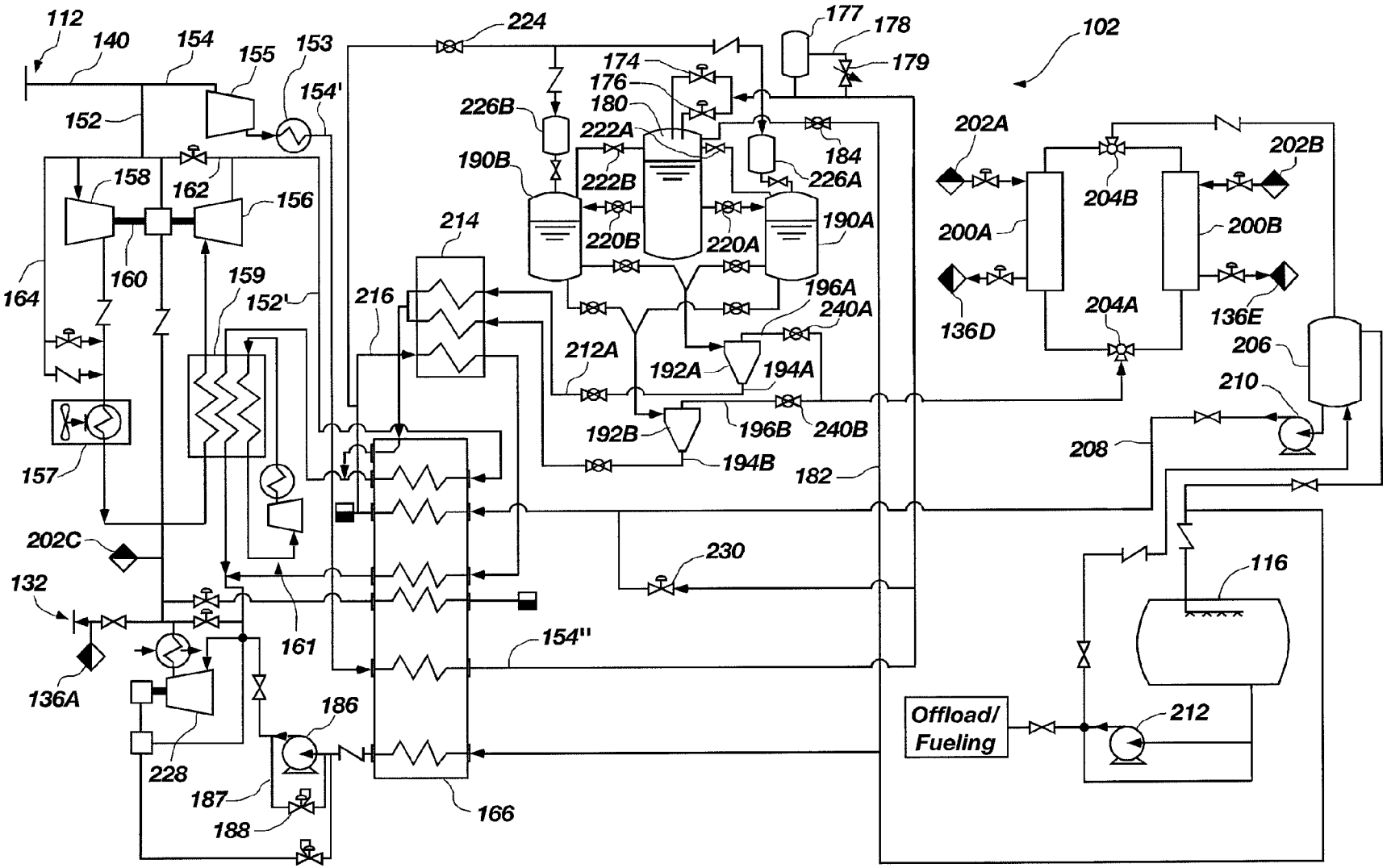
FIG. 2 is a process flow diagram depicting a liquefaction cycle according to one embodiment of the present invention.

Referring now to FIG. 2, a process flow diagram is shown, representative of an embodiment of the liquefaction plant 102 schematically depicted in FIG. 1. As previously indicated with respect to FIG. 1, a high pressure stream of feed gas 140 (e.g., 600 to 800 psia), for example, at a temperature of approximately 60° F. enters the liquefaction plant 102 through the plant inlet 112. While not specifically depicted, prior to processing the feed gas 140, a small portion of feed gas 140 may be split off, passed through a drying filter and utilized as instrument control gas in conjunction with operating and controlling various components in the liquefaction plant 102.

In another embodiment, a separate source of instrument gas, such as, for example, nitrogen, may be provided for controlling various instruments and components within the liquefaction plant 102. As will be appreciated by those of ordinary skill in the art, other instrument controls including, for example, mechanical, electromechanical, or electromagnetic actuation, may likewise be implemented.

Upon entry into the liquefaction plant 102, the feed gas 140 may flow through a filter to remove any sizeable objects which might cause damage to, or otherwise obstruct, the flow of gas through the various components of the liquefaction plant 102. Such a filter may additionally be utilized to remove certain liquid and solid components. Such a filter and its operation have been set forth in greater detail in the various priority patents and patent applications previously incorporated by reference.

The feed gas 140 entering the liquefaction plant 102 is split into a cooling stream 152 and a process stream 154. The process stream 154, or at least a portion thereof, is eventually liquefied, while the cooling stream 152 is utilized to help produce the liquefied gas from the process stream 154. While the embodiment shown and described with respect to FIG. 2 depicts a single stream of feed gas 140, it is noted that separate streams may be provided from a source, such as from the pipeline 104, to provide the feed to the process stream 154 and the cooling stream 152.

Considering the process stream 154 first, the process stream 154 passes through a compressor 155 where the pressure of the process stream 154 is raised to a pressure of approximately 740 psia and a temperature of approximately 102° F. The compressed process stream 154' may pass through a heat exchanger 153 to provide an initial reduction in temperature, and is then passed through a high efficiency heat exchanger 166 to reduce the temperature of the compressed product stream 154' to a temperature of approximately −195° F. at a pressure of approximately 740 psia. By initially compressing the process stream 154, a larger volume of produced liquid may be realized. Additionally, elevated pressures help to keep any $CO_2$ contained within the process stream 154 from plugging the various downstream flow paths.

As set forth in substantial detail in the patents and patent applications which have been incorporated by reference, a water clean-up cycle may be introduced into the process stream 154 or the compressed process stream 154' to remove a water constituent from the feed gas 140 prior to the gas being liquefied. In one embodiment, methanol may be utilized to remove such water from the gas flowing through the process stream 154 and compressed process stream 154'. When methanol is used, it is mixed with the gas stream to lower the freezing point of any water which may be contained therein. The methanol mixes with the gas stream and binds with the water to prevent the formation of ice in one or more flow paths defined within the liquefaction process.

The cooling stream 152 flows through a rotary compressor 158, through a first heat exchanger 157, a second heat exchanger 159 and then through an expander 156. The first heat exchanger 157 may include, for example, an ambient heat exchanger and the second heat exchanger 159 may include, for example, a counterflow type heat exchanger which subjects the cooling stream 152 to a flow of refrigerant. The refrigerant may include a dedicated flow of refrigerant, a flow of cooled gas, as shall be discussed in further detail hereinbelow, or both dedicated refrigerant and a flow of cooled gas. As shown in FIG. 2, both a flow of cooled gas (i.e., the expanded cooling stream 152' after it has exited the heat exchanger 166) and a dedicated refrigerant loop 161 is utilized in conjunction with the second heat exchanger 159.

In one embodiment, after being compressed and flowing through the first and second heat exchangers 157 and 159, the cooling stream 152 may enter a turbo expander 156 at a pressure of approximately 800 psia and at a temperature of approximately −52° F. and is expanded to form an expanded cooling stream 152' exhibiting a lower pressure, for example approximately 215 psia, and a reduced temperature of, for example, approximately −157° F. As will be seen hereinbelow, the expanded cooling stream 152' is a cold mass of fluid that provides cooling during the process of producing liquefied gas.

The turbo expander 156 may include a turbine that expands the gas and extracts power from the expansion process. The compressor 158 may include a rotary compressor 158 that may be coupled to the turbo expander 156 by mechanical means, such as through a shaft 160, so as to utilize the power generated by the turbo expander 156 to compress the process stream 154. In one embodiment, the reduction of pressure of the cooling stream 152 as it flows across the turbo expander 156, provides a substantial portion of the energy used in the liquefaction plant 102, including the power to provide the initial compression of the cooling stream 152, making it more economical to operate the liquefaction plant 102.

In one embodiment, the turbo expander 156 and the compressor 158 system may be designed to operate at up to at least approximately 840 psig at 22,000 pounds mass per hour. The turbo expander/compressor system may also be fitted with gas bearings. Such gas bearings may be supplied with gas through a supply line 155 which draws a portion of the feed gas 140 therethrough. However, the portion of gas directed to any such gas bearing is relatively insubstantial as compared to the mass of gas flowing through the cooling and process lines 152 and 154. In another embodiment, gas bearings may be supplied by a separate flow of gas such as nitrogen. In yet another embodiment, the turbo expander/compressor system may be fitted with other types of bearings including, for example, magnetic bearings or oil bearings.

The expanded cooling stream 152' passes through the heat exchanger 166 to provide cooling to the compressed process stream 154'. After exiting the heat exchanger 166, the expanded cooling stream 152' enters the cold side of the heat exchanger 159. After exiting the heat exchanger 159, the expanded cooling stream 152' may be mixed with other streams and may be compressed or otherwise processed prior to exiting the liquefaction plant 102.

Bypass piping 162 may be used to route the process stream 154 around the compressor 158, the first and second heat exchangers 157 and 159, and the turbo expander 156. Additionally, bypass piping 164 may be used to route the process stream 154 around only the compressor 158. The bypass piping 162 and 164 may be used during startup of the liquefaction plant 102 to bring certain components to a steady state condition prior to the processing of LNG within the liquefaction plant 102. For example, the bypass piping 162 and 164 may be used while various components (such as the heat exchanger 166 which will be discussed hereinbelow), are gradually brought to a steady state temperature so as to avoid inducing thermal shock in such components. Additionally, if the pressure of the feed gas 140 is sufficient, the rotary compressor 158 need not be used and the cooling stream 152 may continue through the bypass piping 164. Indeed, if it is known that the pressure of the feed gas 140 will remain at a sufficiently high pressure, the compressor 158 could conceivably be eliminated. In such a case, where the compressor 158 is not being utilized, the work generated by the turbo expander 156 could be utilized to drive a generator or provide power to some other component if desired. The bypass piping 164 additionally protects the compressor 158 from surging in the event of off-normal flow disruption. For example, if a reduced level of flow through the compressor 158 is sensed or otherwise determined for a given rotational speed of the compressor 158, valves may be opened to recirculate high pressure gas through the bypass piping 164 to the inlet side of the compressor 158.

In one embodiment, the heat exchanger 166 is a high efficiency heat exchanger made from aluminum. In start-up situations it may be desirable to reduce the temperature of such a heat exchanger 166 by, for example, as much as approximately 1.8° F. per minute until a defined temperature limit is achieved. During start-up of the liquefaction plant 102, the temperature of the heat exchanger 166 may be monitored as it incrementally decreases. Valving and other instruments may be controlled in order to effect the rate and pressure of flow in the cooling stream 152 and process stream 154, which ultimately controls the cooling rate of heat exchanger 166 and/or other components of the liquefaction plant.

Additionally, during start-up, it may be desirable to have an amount of LNG already present in the tank 116 (FIG. 1). Some of the LNG may be cycled through the system in order to cool various components if so desired or deemed necessary.

Also, as will become apparent upon further reading of the description below, other cooling devices, including additional JT valves, located in various "loops" or flow streams may likewise be controlled during start-up in order to cool down the heat exchanger 166 or other components of the liquefaction plant 102.

When the liquefaction plant 102 or liquefaction system 100 is in a steady state condition, the process stream 154 flows through the compressor 155 raising the pressure of the process stream 154. The compression process is not thermodynamically ideal and, therefore, adds heat to the process stream 154 as it is compressed. To remove heat from the compressed process stream 154', it is flowed through the high efficiency heat exchanger 166 and is cooled to a very low temperature, for example approximately −190° F. to 195° F. at a pressure, for example, of approximately 740 psia. It is noted that, if the heat of compression is too high, the gas may be precooled, for example, by an ambient heat exchanger 153 prior to its entry into the heat exchanger 166 as previously discussed. The heat exchanger 166 may include a high efficiency heat exchanger and, in one embodiment, may be formed as a countercurrent flow, plate and fin type heat exchanger. Additionally, the plates and fins may be formed of a highly thermally conductive material such as, for example, aluminum. In one embodiment, a high-efficiency heat exchanger may include a multi-pass heat exchanger available from Chart Industries, Inc. of La Crosse, WI.

The heat exchanger 166 is positioned and configured to efficiently transfer as much heat as possible away from the compressed process stream 154' as it passes therethrough. The liquefaction plant 102 is desirably configured such that temperatures generated within the heat exchanger 166 are never low enough to generate solid $CO_2$ which may be present in the feed gas 140, and which formation of solid $CO_2$ might result in blockage in the flow path of the compressed process stream 154'.

After exiting the heat exchanger 166, the cooled, compressed process stream 154" (referred to hereinafter as the product stream 154" for purposes of convenience) flows through two expansion valves, such as JT valves 174 and 176, respectively, and into a liquid/vapor separator 180. The two JT valves 174 and 176 are arranged in a parallel flow configuration and work in concert with one another to control the flow of the product stream 154" into the liquid/vapor separator 180. In one embodiment, the two JT valves 174 and 176 are of different sizes. In other words, the two JT valves 174 and 176 may exhibit different flow coefficients ($C_v$). For example, in one embodiment, one JT valve 174 may be sized and configured to accommodate approximately 80% of the flow entering into the separator 180 from the product stream 154" while the other JT valve 176 may be sized and configured to accommodate the remaining approximately 20% of the flow.

In one embodiment, the larger of the two JT valves 174 and 176 is held at a constant position while the valve carrying the remaining flow is used for the fine control required to maintain a desired flow rate. As the gas expands through the valves, a Joule-Thompson (JT) valve effect reduces the temperature and pressure from, for example, approximately 740 psia at approximately −195° F., to approximately 50 psia and approximately −230° F. (which is the saturation temperature and pressure for the liquid). This pressure drop also precipitates solid $CO_2$. The three phase (gas, liquid, and solid CO2) mixture exiting the JT valves 174 and 176 is collected in the separator 180, wherein a slurry comprising liquid natural gas and solid $CO_2$ is formed and the vapor is separated therefrom.

While a single valve may be used instead of the two JT valves 174 and 176, the use of two (or more) JT valves 174 and 176 provides a more controlled flow and reduces shock or fluctuation in the stream. Additionally, the use of multiple valves may be beneficial during start-up of the liquefaction plant 102 because the gas is less dense in such circumstances.

An accumulator 177 may be coupled with the product stream 154" prior to the stream flowing through the JT valves 174 and 176 to further dampen flow pulses that may be introduced into the stream 154" by the JT valves 174 and 176. A pressure sense line 178 may extend between the accumulator 177 and the product stream 154" and may be buffered by a restrictive valve 179. Additionally, the accumulator 177 may be directly coupled to the product stream 154".

When the product stream 154" passes through the two expansion valves 174 and 176, the product stream 154" follows a constant enthalpy pressure drop that changes from a high pressure, single phase mixture at a high pressure and low temperature (e.g., approximately 740 psia and approximately −195° F.) to three phases (solid, liquid and gas) with approximately 10% to 28% mass flow being vapor, at a reduced pressure of, for example, 50 psia. The solid component includes solid $CO_2$. The vapor component from the separator 180 is collected and removed therefrom through line 182 and is drawn by the suction side of a compressor 186 through the heat exchanger 166 to provide additional cooling. While shown to be located on the warm side of the heat exchanger 166, the compressor 186 could be positioned on the cold side of the heat exchanger 166, although such positioning might require the compressor 186 to be configured as a cryogenic compressor. In one embodiment, the compressor 186 may be powered by an internal combustion engine driven by a portion of the natural gas flowing through the liquefaction plant 102. In another embodiment, the compressor 186 may be powered by electricity or other means as will be appreciated by those of ordinary skill in the art. It is further noted that a device such as an ejector or an eductor might be utilized in place of the compressor 186 in another embodiment.

To maintain the separator 180 at a desired pressure, for example, at approximately 50 psia, the compressor 186 may be used to recompress the excess gas from the separator 180. The compressor 186 may also be coupled to a vent line associated with the storage tank 116 to likewise help maintain the pressure within storage tank 116 at substantially the same pressure as that of the separator 180.

A make-up line 187 having a regulator 188 may be routed around the compressor 186 to prevent flow surges as may be the case when gas from the separator 180 and or storage tank 116 is relatively low. The pressure of such a regulator 188 may be set at a level that is just under the desired saturation pressure for the separator 180. In one embodiment, a floating ball check valve may also be installed in the suction line of the compressor 186 to prevent a sudden surge of liquid. If the compressor 186 is located on the cold side of the heat exchanger 166, a floating ball check valve may also be used to prevent any accumulated liquid from entering the suction side of the compressor 186. It is noted that if the compressor 186 is located on the warm side of the heat exchanger 166, no liquid will be present at the suction side of the compressor 186 under normal operating conditions.

A back-pressure regulator 184 may be located in the vapor line 182 to also help control the pressure within the separator 180. In one example, the back pressure regulator 184 may be configured with a set-point of approximately 50 psia so as to create a saturation pressure of the liquid that is below a desired transfer pressure (i.e., the pressure used to transfer liquid from the separator 180 to other components within the liquefaction plant 102).

In one embodiment, the storage tank 116 may be maintained at substantially the same pressure as that of the separator 180. By maintaining the liquid saturation pressure below associated transfer pressures, the liquid is prevented from boiling when the liquid experiences a pressure drop such as will occur when the liquid flows through piping, valves and other equipment as it is transferred from the separator 180. The pressure difference between the separator 180 (e.g., approximately 50 psia) and a transfer pressure may be specified such that it is sufficient to ensure that any and all line pressure drops encountered en route to the storage tank 116 are accounted for. The liquid will then arrive at the storage tank 116 at saturation pressure, minimizing loss and flow complications that might otherwise occur due to boiling of the liquid during the transfer thereof.

As noted above, solid $CO_2$ mostly forms as small crystals in the liquid as it exits the JT valves 174 and 176. With the appropriate resident time in the liquid, the $CO_2$ becomes a sub-cooled solid particle. In the sub-cooled state the particles are less likely to clump together. Keeping the particles suspended in the liquid provides more effective and efficient transfer and separation of the solids from the liquid component. If allowed to settle, the particles have a tendency to clump or stick together. To aid in keeping the $CO_2$ particles suspended in the liquid, gas bubbles may be introduced into the bottom of the separator 180. Introduction of the gas bubbles helps to agitate the $CO_2$ solids within the liquid and keep the particles continually moving within the liquid. While not specifically shown in FIG. 2, gas may be drawn from a suitable location within the liquefaction plant 102 where the gas stream exhibits a desired pressure and temperature and is introduced into the separator 180 for bubbling through the slurry.

As the separator 180 is filled, the level may be monitored by appropriate sensors. The level of the liquid/solid within the separator 180 may be desirably monitored and controlled in order to provide desired resident times for the $CO_2$ and thereby ensure that the $CO_2$ particles are subcooled.

When a specified maximum level of liquid/solid slurry is reached within the separator 180, the liquid/solid slurry will be transferred to at least one of a plurality of transfer tanks 190A and 190B. In one embodiment, the transfer tanks 190A and 190B are used alternately. The transfer tanks 190A and 190B are utilized to transfer the slurry from the separator 180 to one of a plurality of hydrocyclones 192A and 192B. While it is possible to transfer the slurry from the separator 180 to the hydrocyclones 192A and 192B without the use of the transfer tanks 190A and 190B, it is believed that, in the currently described embodiment, the use of transfer tanks 190A and 190B provides improved control over the transfer of the slurry (including transfer of the slurry to the hydrocyclones 192A and 192B and subsequent transfer of the liquid from the hydrocyclones 192A and 192B to downstream components such as the storage tank 116), and ensures that adequate transfer pressures are maintained during such transfer. If pressures are not properly maintained during transfer of the slurry, the liquid may boil due to pressure losses associated with piping and other components. Additionally, failure to maintain proper pressures during transfer of the slurry may result in inadequate solid-liquid separation. The use of separate, alternating tanks 190A and 190B to effect the transfer of the slurry from the separator 180, is one means that may be used to maintain the pressure integrity of the liquefaction plant 102.

When the separator 180 has reached its specified maximum level, two valves will open allowing the fluid to move into one of the transfer tanks (e.g., transfer tank 190A for purposes of the present discussion). The first valve 220A allows the transfer of liquid/$CO_2$ slurry, while the second valve 222A vents the transfer tank 190A back to the separator 180 enabling the captured gases in the transfer tank 190A to escape as it is being filled with the slurry. Depending, for example, on the length of the piping run between the separator 180 and the transfer tank 190A, bubbler locations may be added to the bottom of the pipe to prevent the $CO_2$ from settling during the transfer of the slurry (similar to that which has been previously described with respect to the separator 180). It is noted that a single valve may be utilized instead of multiple valves if the single valve is properly located (e.g., physically below the separator 180).

When the level in the separator 180 is reduced to a specified level, the first and second valves 220A and 222A, respectively, to the transfer tank 190A close. The liquid/$CO_2$ transfer switches between the two transfer tanks 190A, 190B associated with the separator 180. Once the valves connecting the separator 180 and transfer tank 190A are closed, the liquid/$CO_2$ mixture is ready to be transferred to the hydrocyclone separator. The pressure-sensitive hydrocyclone separator separates the $CO_2$ from the liquid by cyclonic action. The transfer tank is pressurized to the desired pressure and the transfer valve is opened. The transfer pressure is approximately 20 psi higher than the saturation pressure of the liquid. This pressure head provides the motive force for the liquid/$CO_2$ mixture, prevents the liquid from boiling, as pressure drops are realized, and prevents the formation of additional $CO_2$ that could occur if the pressure were to drop below saturation pressure.

By alternating the filling of the two (or more) transfer tanks 190A and 190B, a constant flow of slurry to a selected hydrocyclone (e.g., hydrocyclone 192A) may be easily maintained. The alternating use of transfer tanks 190A and 190B also improves the efficiency and effectiveness of the separation process performed by the hydrocyclones 192A and 192B. It is noted that, if the rate at which liquid is produced (i.e., within the separator 180) falls behind with respect to a desired separation rate of a hydrocyclone 192A, the flow to the hydrocyclone 192A may be suspended while the separator 180 and transfer tanks 190A and 190B fill to a desired level. The transfer tanks 190A and 190B and hydrocyclones 192A and 192B may be oversized to prevent the possibility of producing liquid in the separator 180 faster than the transfer/separation capabilities of the hydrocyclones 192A and 192B.

The transfer tank (considering transfer tank 192A as an example) is pressurized by use of a pressure regulator 224 which is set at a desired transfer pressure. If the feed line to the transfer tank 192A is sufficient and the pressure regulator 224 is large enough, the pressure regulator 224 can be mounted directly on the transfer tank 192A. This would require one regulator for each tank. However, in another embodiment, both transfer tanks 192A and 192B could be maintained with a smaller feed line and a single pressure regulator 224, as shown in FIG. 2. Use of a single pressure regulator may require the use of storage or accumulator tanks (e.g., accumulator tanks 226A and 226B) to ensure that the proper volume of gas is used so as to maintain the pressure constant during the complete transfer process. It is noted that the gas used to transfer the liquid will be warmer than the liquid/solid slurry being transferred. As such, any heat transfer effects are accounted for in configuring and sizing the pressure regulator(s) 224 and accumulator tank(s) 226A and 226B.

As previously noted, the liquid/solid slurry is transferred to, and processed by, one of the hydrocyclones 192A and 192B. The hydrocyclones 192A and 192B act as separators to remove the solid $CO_2$ from the slurry allowing the LNG or other liquid product to be collected and stored. The hydrocyclones 192A and 192B may be configured to be substantially identical to one another. As such, only a single hydrocyclone 192A is referenced with respect to the particular details thereof. In one embodiment, the hydrocyclone 192A may be designed, for example, to operate at a pressure of approximately 215 psia at a temperature of approximately −228° F. The hydrocyclone 192A uses a pressure drop to create a centrifugal force which separates the solids from the liquid. A thickened slush, formed of a portion of the liquid natural gas with the solid $CO_2$, exits the hydrocyclone 192A through an underflow 194A. The remainder of the liquid natural gas is passed through an overflow 196A for additional filtering. A slight pressure differential, for example, between approximately 0.5 psid and 1.5 psid, exists between the underflow 194A and the overflow 196A of the hydrocyclone 192A. The pressure in the hydrocyclone 192A is provided and maintained by the transfer tank (transfer tank 192A or 192B). A control valve 240A may be positioned at the overflow 196A of the hydrocyclone 192A to assist in controlling the pressure differential developed within the hydrocyclone 192A. The underflow pressure may be controlled by the mid-system pressure as may be maintained by the suction side of a recompression compressor 228 (if one is being used) or by the distribution line pressure at the plant outlet 132.

A suitable hydrocyclone 192A may be configured to operate at design pressures of up to approximately 225 psig within a temperature range of approximately 100° F. to −300° F. Additionally, the hydrocyclone 192A may desirably include an interior surface which is micro-polished to an extremely fine finish.

It is noted, that the hydrocyclones 192A and 192B are selectively coupled with each of the transfer tanks 190A and 190B through appropriate valving and piping, such that each of the transfer tanks 190A and 190B may selectively flow slurry to either of the hydrocyclones 192A and 192B. The use of two hydrocyclones 192A and 192B provides redundancy in the system so that if one hydrocyclone becomes plugged (or partially plugged), the other hydrocyclone may be used while appropriate maintenance is performed on the first. If desired, warm gas may be routed from another location in the liquefaction plant 102 to assist in unplugging a hydrocyclone such as by melting or sublimation of solid $CO_2$ that may be the source of any such plugging.

The liquid natural gas flows through the overflow 196A of the hydrocyclone 192A and may flow through one of a plurality of filters 200A and 200B placed in a parallel flow configuration. The filters 200A and 200B capture any remaining solid $CO_2$ which may not have been separated out in the hydrocyclone 192A. The filters 200A and 200B may be configured such as substantially described in the priority patent applications and patents that have been incorporated by reference. Generally, in one embodiment, such filters 200A and 200B may include a first filter screen of coarse stainless steel mesh, a second conical shaped filter screen of stainless steel mesh less coarse than the first filter screen, and a third filter screen formed of fine stainless steel mesh. In another embodiment, all three filter screens may be formed of the same grade of mesh.

The filters 200A and 200B may, from time to time, become clogged or plugged with solid $CO_2$ captured therein. Thus, as one filter, i.e., filter 200A, is being used to capture $CO_2$ (or other solids) from the liquid stream, the other filter, i.e., filter 200B, may be purged of $CO_2$ by passing a relatively high temperature natural gas therethrough in a counter flowing fashion. For example, gas may be drawn from a relatively warmer gas stream, as indicated at connection point 202B (or connection point 202A for filter 200A) and connection point 202C to flow through and clean the filter 200B.

During cleaning of the filter 200B, the cleaning gas may be discharged to a downstream location within the liquefaction plant 102 adjacent the second plant outlet 132 as indicated by interface connection 136E (interface connection 136D for filter 200A) and interface connection 136A. Appropriate valving and piping including, for example, three-way valves 204A and 204B, which may be used to enable the filters 200A and 200B to be switched and isolated from one another as may be required. Other methods of removing $CO_2$ solids (or other solids) that have accumulated in the filters 200A and 200B are readily known by those of ordinary skill in the art.

In another embodiment, the filters 200A and 200B may be configured to include a floating bed that traps solid $CO_2$ while permitting fluid to pass therethrough. As the floating bed becomes filled with $CO_2$, the trapped $CO_2$ settles to the bottom. When the filter (e.g., filter 200A) is filled with $CO_2$, an elevated pressure differential develops indicating that the filter 200A needs to be cleaned and flow can be switched to the redundant filter (e.g., filter 200B). The first filter 200A may then be cleaned in a manner similar to that which has been described hereinabove.

The filtered liquid passes from the filter 200A (or filter 200B) to a diversion tank 206. Liquid in the diversion tank 206 may be selectively passed to the storage tank 116, utilized for additional cooling within the liquefaction plant 102, or both. When used for additional cooling, the liquid in the diversion tank 206 may be routed back to the heat exchanger 166, such as through stream 208 and by use of an appropriate pump 210 (referred to herein as a diversion pump). The diversion pump 210 may also be used to elevate the pressure of the liquid such that it may be subsequently reintroduced into the pipeline 104. For example, a positive displacement pump may be used to pump liquid out of the diversion tank 206 to the heat exchanger 166 while increasing the pressure of the liquid to, for example, approximately 515 psia if the liquid is going to be passed back to the pipeline 104 (or some other receiving line). By pressurizing the liquid to a distribution pressure, the load on the recompression compressor 228 is reduced, it being more efficient to compress a liquid than it is to compress a gas.

The diversion tank 206 may also be supplied with liquid by way of a make-up pump 212 coupled with an outlet of the storage tank 116. In the event of off normal or startup conditions, where the liquefaction plant 102 is not supplying adequate liquid to keep the diversion tank 206 full, the make-up pump 212 may be used to supply the needed liquid. When the liquid level drops to a predetermined level within the diversion tank 206, the make-up pump 212 will start and fill the diversion tank 206 back to a desired level. Thus, a supply of liquid may be maintained in the diversion tank 206 which may be pumped into the heat exchanger 166 to assist in preparing the liquefaction plant 102 for the liquid production process. In other words, the cryogenic liquid in the diversion tank 206 may be used provide cooling during in the final stages of the heat exchanger 166 in order to reduce the temperature of what becomes the compressed product stream 154" to temperatures required for liquid production.

In one embodiment, the flow of liquid from the diversion tank 206 to the heat exchanger 166 may be controlled based on the temperature of the product stream 154". Thus, for example, as the temperature of the product stream 154" becomes warmer, the diversion pump 210 may provide additional flow of liquid from the diversion tank 206 to the heat exchanger 166. Additionally, as the temperature of the product stream 154" decreases, the diversion pump 210 may be controlled to reduce the amount of liquid being provided to the heat exchanger 166. The diversion pump 210 may be configured as a variable flow pump and controlled, for example, by a proportional, integral, derivative (PID) controller.

Referring back to the hydrocyclones 192A and 192B, the thickened slush formed in the hydrocyclone (e.g., hydrocyclone 192A) exits the underflow 194A and passes through piping 212A to a sublimation tank 214. The sublimation tank 214 may include, for example, a heat exchanger configured to convert the solid $CO_2$ to a gaseous state.

In one particular embodiment, the sublimation tank 214 may include a tube-in-shell heat exchanger, such as that which is disclosed in the priority applications and patents previously incorporated by reference. The slush may enter such a heat exchanger on the tube side thereof. Relatively warm gas (i.e., relative to the temperature of the underflow 194A of the hydrocyclone 192A), for example, gas at a temperature of approximately −50° F., may flow through the sublimation tank 214 by way of a flow path 216 from the heat exchanger 166, or from some other location, to heat the slush and effect sublimation of the solid $CO_2$.

It has been determined that, in natural gas mixtures found in conventional U.S. pipelines, $CO_2$ becomes a solid at approximately −160° F. at approximately 35 psig. However, once the $CO_2$ has frozen, it no longer follows the phase change path it would when found in the natural gas mixture. Instead, the solid $CO_2$ acts as pure $CO_2$ which sublimes at approximately −80° F. and at approximately 35 psig.

As the slush enters the sublimation tank 214, the liquid carrier may violently flash to a gas which, in addition to transferring heat to the solid $CO_2$, provides a positive motive flow for the solid $CO_2$. Due to the turbulent nature of the flow, the $CO_2$ constantly interacts with tube walls as it progresses through the tubes. Additionally, the tube walls become progressively warmer along the flow path of the $CO_2$. Once all of the liquid has flashed to a gas and warmed to approximately −80° F., the $CO_2$ will start to sublime, aided by the relatively warm tube walls and the warmed gases. It is noted that the sublimation tank 214 may be configured such that the warm gas from stream 216 will warm all areas of the shell (when configured as a tube-in-shell heat exchanger) to a temperature above the sublimation temperature of the $CO_2$. In this manner, the sublimation tank 214 becomes "self-thawing" in the case of any potential plugs caused by the solid $CO_2$ passing through the tube side thereof.

The sublimed $CO_2$ leaves the sublimation tank 214, passes through a portion of the heat exchanger 166, combines with the expanded cooling stream 152' as it also exits the heat exchanger 166 and passes through the second heat exchanger 159 prior to flowing through recompression compressor 228. In other embodiments, the sublimed $CO_2$ may be combined with the expanded cooling stream 152 at some other location (for example, prior to the expanded cooling stream 152 entering the heat exchanger 166). In yet other embodiments, the sublimed $CO_2$ may be combined with other streams or exit the liquefaction plant 102 from other locations depending, for example, on the site conditions and the operating conditions of the liquefaction plant 102. The warming gas from flow path 216 exits the sublimation tank 214, passes through the heat exchanger 166, and combines with the expanded cooling stream 152' after the expanded cooling stream 152' exits the second heat exchanger 159.

As previously noted hereinabove, the liquefaction plant 102 may include a recompression compressor 228. The recompression compressor 228 may be used to recompress gas to a desired pressure prior to reintroduction of the gas into the pipeline 104 (or other receiving station or system). Gas from the separator 180 and from the storage tank 116 may be used, for example, as fuel for a combustion engine that drives the recompression compressor 228.

It is noted that, while not specifically shown, a number of valves may be placed throughout the liquefaction plant 102 for various purposes such as facilitating physical assembly and start-up of the liquefaction plant 102, maintenance activities, or for collecting of material samples at desired locations throughout the liquefaction plant 102 as will be appreciated by those of ordinary skill in the art.

It is further noted that the liquefaction plant 102 may be configured as a relatively compact structure such as described in the applications and patents previously incorporated by reference. Generally, the liquefaction plant 102 may be constructed on one or more skids for simple transportation and erection of the liquefaction plant 102.

The liquefaction plant 102 may further include controls such that minimal operator input is required for the operation of the liquefaction plant 102. Indeed, it may be desirable that the liquefaction plant 102 be able to function without an on-site operator. Thus, with proper programming and control design, the liquefaction plant 102 may be accessed through remote telemetry for monitoring and/or adjusting the operations of the liquefaction plant 102. Similarly, various alarms may be built into such controls so as to alert a remote operator or to shut down the plant in an upset condition. One suitable controller, for example, may be a DL405 series programmable logic controller (PLC) commercially available from Automation Direct of Cumming, Ga.

Reviewing now the operation of the liquefaction plant 102 and considering various control aspects thereof, when the liquefaction plant 102 is started, the JT valves 174 and 176 are closed such that the product stream 154" is diverted back into the heat exchanger 166 after passing through a JT valve 230. This produces a cooling stream that may be used to cool the heat exchanger 166 until the temperature of the product stream 154" approaches a desired temperature and pressure. When starting, the expander 156/compressor 158 will be manually accelerated at a rate that corresponds with approximately 2° F. per minute temperature reduction in the heat exchanger 166. This acceleration may stop when the pressure of the compressed process stream 154' builds to the specified pressure. If the pressure of the pipeline 104 or other source is running at the specified pressure (e.g., approximately 740 psia), use of the compressor 158 may not be necessary. However, the compressor 158 may be started to provide a desired boost in pressure to the process stream 154.

Prior to closing the JT valve 230 in the cooling stream and opening JT valves 174 and 176, the diversion tank 206 may be filled with liquid from the storage tank 116. The flow may simply fill the diversion tank 206 or it may recirculate back into the storage tank 116. When the temperature of the product stream 154" reaches a desired temperature, the flow of product stream 154" is routed to the separator 180. At this time, the diversion pump 210 will start pumping liquid from the diversion tank 206 to the heat exchanger 166 to aid in the final and rapid cooling of the compressed process stream 154'.

Switching the flow of the product stream 154" into the separator 180 will prevent $CO_2$ from building up in the heat exchanger 166. It is noted that $CO_2$ formation begins when the pressure drops from approximately 740 psia at a temperature of approximately −190 °F. to −195° F. to a pressure of approximately 50 psia at a temperature of approximately −228° F. The initially warm tank of the separator 180 will flash the small amount of liquid and $CO_2$ to a gas, as the temperature of the product stream 154" decreases. Decreased temperatures in the product stream 154" result in the production of additional liquid. The liquid quality will also improve as the temperature drops and the $CO_2$ will be suspended in the liquid as the tank of the separator 180 cools to a point at which the liquid remains.

If the separator 180 should fill before the temperature of the product stream 154" is within the desired range, the separator 180 may be flushed. Flushing the cold liquid into the warm transfer tanks 190A and 190B will boil off most of the liquid and any remaining liquid may be used to continue cooling off various components of the liquefaction plant 102. As the temperature of the product stream 154" reaches a desired range of, for example, approximately −180° F. to approximately −200° F., the expander 156 will be slowly accelerated to a desired operational speed.

During operation of the liquefaction plant 102, the temperature and pressure of the expanded cooling stream 152' exiting the expander 156 may be used as process control points. Such parameters may be managed to maximize the production of liquid. Generally, the expanded cooling stream should not be colder than the solidification temperature of $CO_2$. Otherwise, plugging will result in the heat exchanger 166 or other components of the liquefaction plant 102. In one embodiment, it is desirable to maintain the temperature of the expanded cooling stream 152' as it enters the heat exchanger 166 in a range of approximately −150 °F. to −157° F. at a pressure of approximately 50 to 250 psig and desirably at a pressure of approximately 185 psig.

During operation of the liquefaction plant 102, the relationship between the "back-end flow loop" and the "cooling loop" may also be used as the basis for the liquid production and control of the liquefaction plant 102. The back-end flow loop generally refers to the flow of fluid through the liquid handling components of the plant and particularly the flow through the valve or valves (e.g., JT valves 174 and 176) leading into the gas-liquid separator 180. The cooling loop refers generally to flow of fluid that provides cooling via the heat exchanger 166 during normal operating conditions and particularly includes the flow of liquid from the diversion tank 206.

Specific control schemes regarding the relationship of the back-end flow loop and the cooling loop, as well as control schemes based on other relationships, are described in the various documents that have been incorporated by reference herein.

Figure 3:
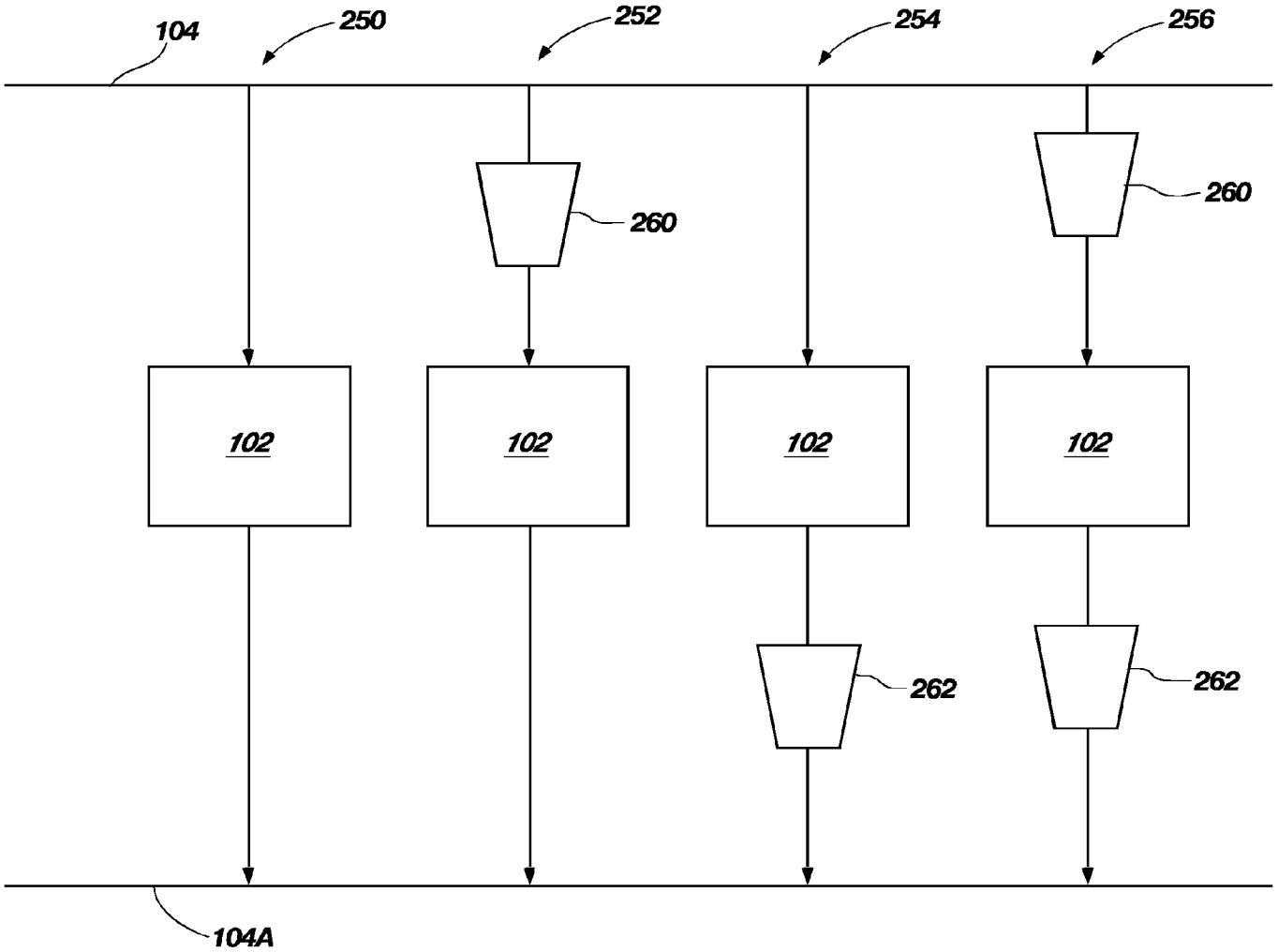
FIGS. 3 and 4 are schematics showing various configurations for embodiments of the present invention based on site options and supply conditions.

It is noted that various configurations of the plant may be utilized depending, for example, on site conditions and supply options. For example, referring to FIG. 3, and considering a two line site (i.e., a separate supply line 104 and tail gas line 104A), four different general configurations are shown. Depending on the gas pressure in the supply line 104 and the tail gas line 104A, various combinations of precompression or post compression may be used. Referring to a first configuration 250, the liquefaction plant 102 may be installed between the supply line 104 and the tail gas line 104A without any additional precompression or post compression required. This scenario is a generally desirable scenario and may be implemented when the pressures of the gas in the supply line 104 and tail gas line 104A are at suitable pressures for operating the liquefaction plant 102.

A second configuration 252 includes a compressor 260 for precompression of the gas prior to entering the liquefaction plant 102. This configuration enables siting of the liquefaction plant 102 where the supply pressure is inadequate. However, the cost of the liquid product is increased as compared to the first configuration 250 due to the added precompression.

A third configuration 254 includes a compressor 262 for post compression of the gas leaving the liquefaction plant 102. This configuration enables siting of the liquefaction plant 102 where the tail gas pressure is inadequate. The cost of the liquid product may be increased in the third configuration 254 as compared to the first configuration 252 due to the added post compression depending, for example, on the specific pressures, flow rates and amount of post compression required.

A fourth configuration 256 includes a compressor 260 for precompression of the gas entering the liquefaction plant 102, and a compressor 262 for post compression of the gas leaving the liquefaction plant 102. This configuration enables siting of the liquefaction plant 102 where both the supply pressure and the tail gas pressure are inadequate. The cost of the liquid product may be increased in the fourth configuration 256 as compared to the other configurations 250, 252 and 254 due to the added pre- and post compression. Of course, as noted hereinabove, depending on specific conditions and operating parameters, one of the configurations using pre- or post compression may actually be more desirable.

Figure 4:
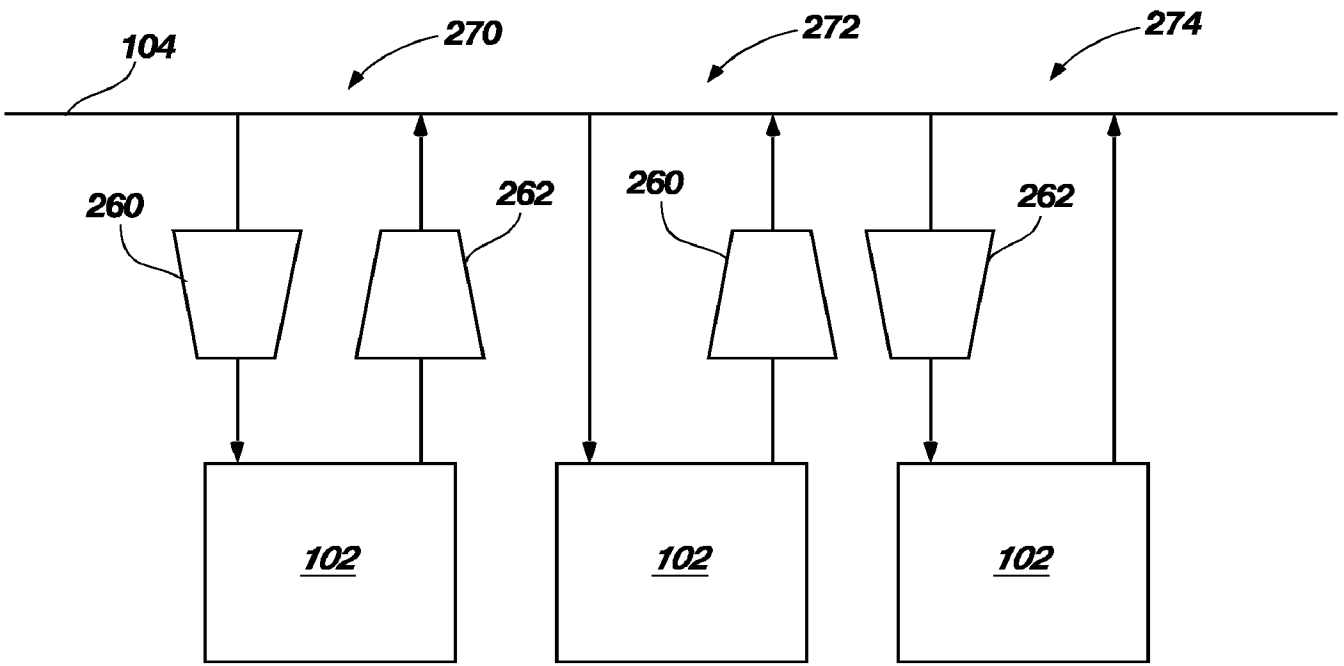

Referring now to FIG. 4, options are shown for a single line site (i.e., where gas is drawn from and discharged into the same supply line 104). Depending on the supply pressure, and the pressure differential experienced by the liquefaction plant 102 (i.e., between inlet from and discharge to the supply line 104), various schemes of pre- and post compression may be used. For example, compressors 260 and 262 may be used to both pre- and post compression as set forth in the first configuration 270. In another embodiment, only one compressor 262 may be used for post compression as indicated in configuration 272. In yet another embodiment, only one compressor 260 may be used for precompression as indicated in configuration 274.

By selecting a site based on the known pressures of supply lines and/or tail gas lines, and taking into account the operating pressures of the liquefaction plant 102, a significant increase in efficiency of the liquefaction plant 102 may be achieved with, for example, a reduction of required compression horsepower of up to, or more than, one half as compared to previously known designs.

EXAMPLE

Figure 5:
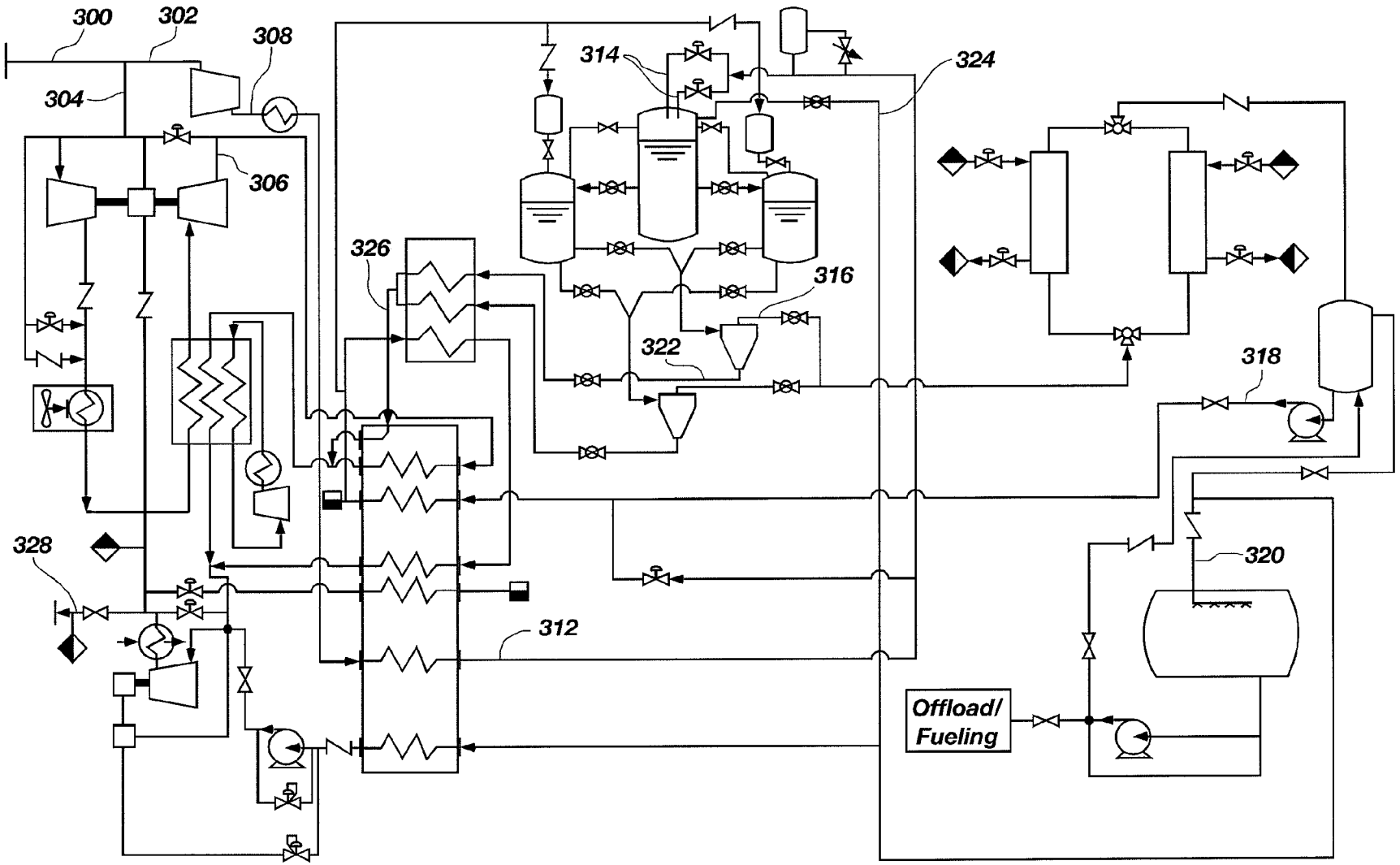
FIG. 5 is a process flow diagram showing state points of the flow mass throughout the system according to one embodiment of the present invention.

Referring now to FIGS. 2 and 5, an example of the process carried out in the liquefaction plant 102 is set forth. It is noted that FIG. 5 is the same process flow diagram as FIG. 2 but with component reference numerals omitted for clarity. As the general process has been described above with reference to FIG. 2, the following example will set forth examples of conditions of the gas/liquid/slurry at various locations throughout the liquefaction plant 102, referred to herein as state points, according to the calculated operational design of the liquefaction plant 102. The following example is based on a configuration of a supply line having a pressure of approximately 600 psig, a tail gas line having a pressure of approximately 500 psig, using pre- and post compression, with a design production of approximately 40,000 gallons of liquid per day at a saturation pressure of approximately 35 psig.

At state point 300, as the gas leaves the supply pipeline and enters the liquefaction plant 102, the gas will be approximately 60° F. at a pressure of approximately 615 psia with a flow of approximately 35,100 lbm/hr.

At state points 302 and 304, the flow will be split such that approximately 13,300 lbm/hr flows through state point 302 and approximately 21,800 lbm/hr flows through state points 302, 304 with temperatures and pressures of each state point 302, 304 being similar to that of state point 300.

At state point 306, as the stream exits the turbo expander 156, the gas will be approximately −157° F. at a pressure of approximately 215 psia. At state point 308, as the gas exits the compressor 158, the gas will be approximately 102° F. at a pressure of approximately 740 psia.

At state point 308, after heat exchanger 153 and prior to the high efficiency heat exchanger 166, the gas will be approximately 100° F. at a pressure of approximately 740 psia.

The gas exiting the high efficiency heat exchanger 166, as shown at state point 312, will be approximately −190° F. at a pressure of approximately 740 psia.

At state point 314, after passing through the Joule-Thomson valves, and prior to entering the separator 180, the product stream 154" will become a mixture of gas, liquid natural gas, and the solid $CO_2$ and will be approximately −230° F. at a pressure of approximately 50 psia. The material will be in substantially the same state as it enters the transfer tanks 190A and 190B. The transfer tanks 190A and 190B will boost the pressure of the liquid slurry as may be required by the hydrocyclone to achieve effective separation. The liquid temperature stays about the same (−230° F.) and becomes subcooled during this pressure boost.

At state point 316, after being separated via the hydrocyclone 258, the liquid natural gas will be approximately −228° F. at a pressure of approximately 216 psia with a flow rate of approximately 9,003 lbm/hr. At state point 318, after flowing through a polishing filter 266A or 266B, the diversion tank 206, and the diversion pump 210, the temperature of the liquid natural gas will be approximately −226° F. and the pressure will be approximately 515 psia at a mass flow rate of approximately 3,205 lbm/hour.

At state point 320, as the liquid enters the storage vessel 116, the liquid will be at a temperature of approximately −230° F. with a pressure of approximately 50 psia at a mass flow rate of approximately 5,798 lbm/hr.

At state point 322 the thickened slush (including solid $CO_2$) exiting the hydrocyclone 192A or 192B will be approximately −228° F. at a pressure of approximately −215 psia and will flow at a rate of approximately 1,737 lbm/hr.

At state point 324, the gas exiting the separator 180 will be approximately −230° F. at a pressure of approximately 50 psia with a flow rate of approximately 2,561 lbm/hr.

At state point 326, upon exiting the sublimation tank 214, the temperature of the gas will be approximately −70° F. and the pressure will be approximately 512 psia. The flow rate at state point 326 will be approximately 1,950 lbm/hr.

At state point 328, and at the point of anticipated discharge from the liquefaction plant 102, the gas will have a temperature of approximately 277° F. and a pressure of approximately 515 psia. The flow rate at state point 328 will be approximately 28,400 lbm/hr.

The liquefaction processes depicted and described herein with respect to the various embodiments provide for low cost, efficient and effective means of producing LNG.

It is noted that, while the invention has been disclosed primarily in terms of liquefaction of natural gas, the present invention may be utilized simply for removal of gas components, such as, for example, $CO_2$ from a stream of relatively "dirty" gas. Additionally, other gases, such as for example, hydrogen, may be processed and other gas components, such as, for example, nitrogen, may be removed from a given feed gas. Thus, the present invention is not limited to the liquefaction of natural gas and the removal of $CO_2$ therefrom.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A method of liquefying a gas, the method comprising:
providing a source of gas and flowing a portion of the gas from the source;
dividing the portion of the gas into at least a process stream and a cooling stream;
flowing the process stream sequentially through a first compressor and a first side of at least one heat exchanger;
flowing the cooling stream sequentially through a second compressor and a second side of the at least one heat exchanger;
expanding at least a portion of the process stream subsequent flowing the process stream through the first side of at least one heat exchanger to produce a liquid;
producing a slurry of liquid natural gas and solid carbon dioxide from the at least a portion of the process stream within a liquid-gas separator; and
transferring at least a portion of the slurry from the liquid-gas separator to at least one transfer tank to maintain adequate transfer pressure of the slurry delivered from the separator.

2. The method according to claim 1, further comprising flowing the cooling stream through an expander subsequent to flowing the cooling stream through a second compressor and prior to flowing the cooling stream through the second side of the at least one heat exchanger.

3. The method according to claim 2, further comprising flowing the cooling stream through at least one other heat exchanger subsequent to flowing the cooling stream through a second compressor and prior to flowing the cooling stream through the expander.

4. The method according to claim 1, further comprising flowing at least a portion of the process stream through the second side of the at least one heat exchanger.

5. The method according to claim 1, wherein expanding at least a portion of the process stream includes flowing the at least a portion of the process stream through an expansion device into the gas-liquid separator.

6. The method according to claim 1, wherein expanding at least a portion of the process stream further includes flowing the at least a portion of the process stream through at least one expansion valve.

7. The method according to claim 6, wherein flowing the at least a portion of the process stream through at least one expansion valve includes flowing the at least a portion of the process stream through at least two expansion valves.

8. The method according to claim 7, further comprising arranging the at least two expansion valves in a parallel flow configuration.

9. The method according to claim 8, further comprising configuring a first expansion valve of the at least two expansion valves to exhibit a first flow capacity (Cv) and configuring a second valve of the at least two expansion valves to exhibit a second Cv, different from the first Cv.

10. The method according to claim 8, further comprising flowing approximately 80% of the at least a portion of the process stream through a first expansion valve of the at least two expansion valves.

11. The method according to claim 10, further comprising flowing the remainder of the at least a portion of the process stream through a second expansion valve of the at least two expansion valves.

12. The method according to claim 1, wherein transferring at least a portion of the slurry from the liquid-gas separator to at least one transfer tank further comprises selectively transferring at least a portion of the slurry from the liquid-gas separator to a plurality of transfer tanks.

13. The method according to claim 12, further comprising flowing the at least a portion of the slurry from at least one of the plurality of transfer tanks to at least one hydrocyclone.

14. The method according to claim 13, wherein flowing the at least a portion of the slurry from at least one of the plurality of transfer tanks to at least one hydrocyclone further comprises selectively flowing the at least a portion of slurry from at least one of the plurality of transfer tanks to a plurality of hydrocyclones.

15. The method according to claim 13, further comprising flowing a slush that is rich in solid carbon dioxide though an underflow of the at least one hydrocyclone to a sublimation tank.

16. The method according to claim 15, further comprising subliming the solid carbon dioxide to a gas.

17. The method according to claim 13, further comprising flowing liquid natural gas though an overflow of the at least one hydrocyclone to a diversion tank.

18. The method according to claim 17, further comprising flowing the liquid natural gas though at least one filter prior to flowing the liquid natural gas to the diversion tank.

19. The method according to claim 17, further comprising flowing at least a portion of the liquid natural gas from the diversion tank to a second side of the at least one heat exchanger.

20. The method according to claim 19, further comprising flowing at least a portion of the liquid natural gas to a storage tank.

21. The method according to claim 20, further comprising flowing at least a portion of the cooling stream back into the source of gas.

22. The method according to claim 21, further comprising compressing the at least a portion of the cooling stream prior to flowing it into the source of unpurified natural gas.

23. The method according to claim 1, further comprising compressing the portion of the natural gas flowed from the source prior to dividing the portion of natural gas into at least a process stream and a cooling stream.

24. The method according to claim 1, further comprising flowing the process stream through at least one other heat exchanger subsequent flowing the process stream through a first compressor and prior to flowing the cooling stream through the first side of the at least one heat exchanger.

25. A liquefaction plant comprising:

a first flow path defined and configured for sequential delivery of a first stream of gas through a first compressor and a first side of at least one heat exchanger;

a second flow path defined and configured for sequential delivery of a second stream of gas through a second compressor and a second side of the at least one heat exchanger;

a product flow path defined and configured for delivery of the first stream of gas from the first flow path through at least one expansion device and into a gas liquid separator for producing a slurry of liquid natural gas and solid carbon dioxide from the at least a portion of the process stream within the liquid-gas separator; and a transfer tank located and configured to receive a solid-liquid slurry from the gas-liquid separator to maintain adequate transfer pressure of the slurry delivered from the separator.

26. The liquefaction plant of claim 25, wherein the second flow path is further defined and configured to deliver the second stream of gas through an expander subsequent the second compressor and prior to the second side of the at least one heat exchanger.

27. The liquefaction plant of claim 26, wherein the second flow path is further defined and configured to deliver the second stream of gas through at least one other heat exchanger subsequent the second compressor and prior to expander.

28. The liquefaction plant of claim 25, wherein the at least one transfer tank includes at least two transfer tanks which are in selective communication with the gas-liquid separator.

29. The liquefaction plant of claim 28, further comprising at least one hydrocyclone in selective communication with the at least one transfer tank.

30. The liquefaction plant of claim 29, further comprising a diversion tank in communication with an overflow of the at least one hydrocyclone.

31. The liquefaction plant of claim 30, further comprising a pump located and configured to convey a mass of liquid from the diversion tank to the second side of the at least one heat exchanger.

32. The liquefaction plant of claim 30, further comprising a storage tank in selective communication with the diversion tank.

33. The liquefaction plant of claim 30, further comprising at least one filter disposed in a flow path extending between the at least one hydrocyclone and the diversion tank.

34. The liquefaction plant of claim 29, further comprising a sublimation tank in communication with an underflow of the at least one hydrocyclone.

35. The liquefaction plant of claim 25, further comprising a recompression compressor configured to receive a flow of gas from the second side of the at least one heat exchanger.

36. The liquefaction plant of claim 35, further comprising another flow path from the recompression compressor to an exit of the plant.

* * * * *

UNITED STATES PATENT AND TRADEMARK OFFICE

CERTIFICATE OF CORRECTION

PATENT NO. : 7,637,122 B2
APPLICATION NO. : 11/536477
DATED : December 29, 2009
INVENTOR(S) : Turner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 420 days.

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,122 B2
APPLICATION NO. : 11/536477
DATED : December 29, 2009
INVENTOR(S) : Terry D. Turner, Bruce M. Wilding and Michael G. McKellar It is certified that error appears in the above-identified patent and that said Letters Patent is hereby corrected as shown below:

In the specification:

COLUMN 9, LINE 15, change "195°" to -- -195° --

Signed and Sealed this
Twenty-seventh Day of August, 2013

Teresa Stanek Rea
*Acting Director of the United States Patent and Trademark Office*